US010919133B2

(12) United States Patent
Kukucka et al.

(10) Patent No.: US 10,919,133 B2
(45) Date of Patent: Feb. 16, 2021

(54) ANTI-SLIP TORQUE TOOL WITH INTEGRATED ENGAGEMENT FEATURES

(71) Applicant: GRIP HOLDINGS LLC, Brandon, FL (US)

(72) Inventors: Paul Kukucka, Brandon, FL (US); Thomas Stefan Kukucka, Brandon, FL (US)

(73) Assignee: GRIP HOLDINGS LLC, Brandon, FL (US)

( * ) Notice: Subject to any disclaimer, the term of this patent is extended or adjusted under 35 U.S.C. 154(b) by 0 days.

(21) Appl. No.: 16/872,050

(22) Filed: May 11, 2020

(65) Prior Publication Data

US 2020/0353606 A1 Nov. 12, 2020

Related U.S. Application Data

(60) Provisional application No. 62/845,731, filed on May 9, 2019.

(51) Int. Cl.
*B25B 23/00* (2006.01)
*B25B 13/04* (2006.01)
*B25B 13/08* (2006.01)

(52) U.S. Cl.
CPC ..... *B25B 23/0071* (2013.01); *B25B 13/04* (2013.01); *B25B 13/08* (2013.01)

(58) Field of Classification Search
CPC ... B25B 23/0071; B25B 13/04; B25B 13/065; B25B 13/08
See application file for complete search history.

(56) References Cited

U.S. PATENT DOCUMENTS 3,242,775 A * 3/1966 Hinkle ..... B25B 13/065 81/119
4,930,378 A * 6/1990 Colvin ..... B25B 13/065 411/403
5,148,726 A * 9/1992 Huebschen ..... B25B 13/00 81/119
5,284,073 A * 2/1994 Wright ..... B25B 13/065 81/121.1
5,551,322 A * 9/1996 Mikic ..... B25B 13/08 81/119
6,098,501 A * 8/2000 Sundstrom ..... B25B 13/04 81/119
6,907,805 B2 * 6/2005 Wright ..... B25B 13/08 81/119

(Continued)

*Primary Examiner* — David B. Thomas

(57) ABSTRACT

An anti-slip torque tool with integrated engagement features includes a torque-tool body, at least one pair of diametrically opposing engagement features, and an intermediate feature. The pair of diametrically opposing engagement features includes a first opposing feature and a second opposing feature and functions as engagement features around the head portion of the fastener that needs to be removed. The first opposing feature and the second opposing feature are radially distributed around a rotational axis of the torque-tool body. The first opposing feature and the second opposing feature are terminally connected to each other by the intermediate feature. The torque-tool body is outwardly extended from the first opposing feature, the second opposing feature, and the intermediate feature thus delineating an opening to receive the head portion of the fastener.

16 Claims, 20 Drawing Sheets

(56) References Cited

U.S. PATENT DOCUMENTS

| | | | | |
|---|---|---|---|---|
| 7,261,020 | B2 * | 8/2007 | Hsieh | B25B 13/04 81/121.1 |
| 7,340,982 | B2 * | 3/2008 | Wright | B25B 13/08 81/119 |
| 7,661,339 | B2 * | 2/2010 | Wu | B25B 27/18 81/186 |
| 7,788,994 | B2 * | 9/2010 | Wright | B25B 13/08 81/119 |
| 8,359,952 | B2 * | 1/2013 | Hsieh | B25B 27/18 81/119 |
| 8,869,660 | B2 * | 10/2014 | Hsieh | B25B 13/04 81/186 |
| 9,120,210 | B2 * | 9/2015 | Lee | B25B 13/08 |
| 9,718,170 | B2 * | 8/2017 | Eggert | B25B 13/065 |
| 10,442,060 | B2 * | 10/2019 | Eggert | B25B 13/065 |
| 10,596,685 | B2 * | 3/2020 | Lee | B25B 13/065 |
| 2006/0130618 | A1 * | 6/2006 | Hsieh | B25B 13/065 81/121.1 |
| 2006/0150782 | A1 * | 7/2006 | Hsieh | B25B 13/065 81/121.1 |
| 2006/0156869 | A1 * | 7/2006 | Hsieh | B25B 13/04 81/121.1 |
| 2019/0001469 | A1 * | 1/2019 | Cho | B25B 23/0035 |

* cited by examiner

ANTI-SLIP TORQUE TOOL WITH INTEGRATED ENGAGEMENT FEATURES

The current application claims a priority to a U.S. provisional application Ser. No. 62/845,731 filed on May 9, 2019. The current application is filed on the next business day, which is May 11, 2020, while May 9, 2020 was on a weekend.

FIELD OF THE INVENTION

The present invention generally relates to various fastening methods. More specifically the present invention is an anti-slip torque tool with integrated engagement features to prevent damaging or stripping fasteners during the extraction or tightening process.

BACKGROUND OF THE INVENTION

Hex bolts, nuts, screws, and other similar threaded devices are used to secure and hold multiple components together by being engaged to a complimentary thread, known as a female thread. The general structure of these types of fasteners is a cylindrical shaft with an external thread and a head at one end of the shaft. The external thread engages a complimentary female thread tapped into a hole or a nut and secures the fastener in place, fastening the associated components together. The head receives an external torque force and is the means by which the fastener is turned, or driven, into the female threading. The head is shaped specifically to allow an external tool like a wrench to apply a torque to the fastener in order to rotate the fastener and engage the complimentary female threading to a certain degree. This type of fastener is simple, extremely effective, cheap, and highly popular in modern construction. One of the most common problems in using these types of fasteners, whether male or female, is the tool slipping in the head portion, or slipping on the head portion. This is generally caused by either a worn fastener or tool, corrosion, overtightening, or damage to the head portion of the fastener.

It is an objective of the present invention to provide a torque tool that virtually eliminates slippage, when used in conjunction with the appropriate matching fastener. The present invention uses a series of segmented portions that bite into the head of the fastener and allow for efficient torque transfer between the torque tool and the head portion of the fastener. The present invention eliminates the need for the common bolt extractors as they require unnecessary drilling and tools. The present invention is preferably built into an opened end, a boxed end wrench type torque tool, or socket wrench so that the users can selectively utilize the present invention with reference to the different types of fasteners.

DETAIL DESCRIPTIONS OF THE INVENTION

All illustrations of the drawings are for the purpose of describing selected versions of the present invention and are not intended to limit the scope of the present invention.

The present invention is anti-slip torque tool with integrated engagement features that is used to tighten or loosen any fastener such as a nut or bolt. Traditional wrench and wrench socket designs transfer the majority of the torque to the fastener through the lateral corners of the fastener head. Over time, the degradation of the lateral corners reduces the efficiency of transferring torque from the wrench to the fastener head and, as a result, causes slippage. The present invention overcomes this problem through the use of grooves integrated into the lateral surfaces of the torque tool which provide an additional biting point for the fastener head, regardless of the wear and tear of the fastener head.

The present invention utilizes sets of teeth to engage the flank surface of the fastener head and away from the lateral corner, damaged or otherwise, in order to efficiently apply torque onto the fastener. The sets of teeth allow an improved grip to be applied on to the fastener head by a torque tool. The present invention may be integrated into or utilized by a variety of general tools to increase the torque force applied to a fastener. General tools include, but are not limited to, open-end wrenches, boxed-end wrenches, adjustable wrenches, pipe wrenches, socket wrenches, plumber wrench, and other similar fastener engaging tools. The present invention is compatible with male-member based head designs of fasteners. Fasteners which utilize a male-member head design, also known as male fasteners, use the external lateral surface of the fastener head to engage a tool for tightening or loosening, such fasteners include hex bolts and nuts. In addition, the present invention is compatible with fasteners of a right-hand thread and fasteners of a left-hand thread. Furthermore, the present invention may be altered and configured to fit different types and different sizes of fasteners.

Figure 1:
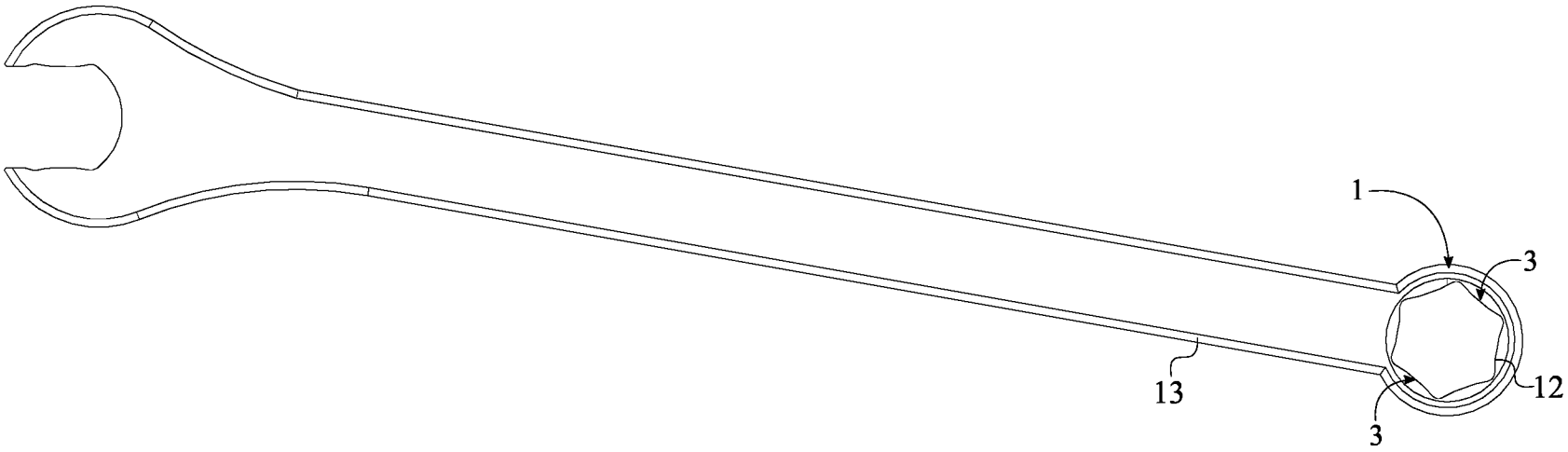
FIG. 1 is a top view of an embodiment of the present invention.
Figure 2:
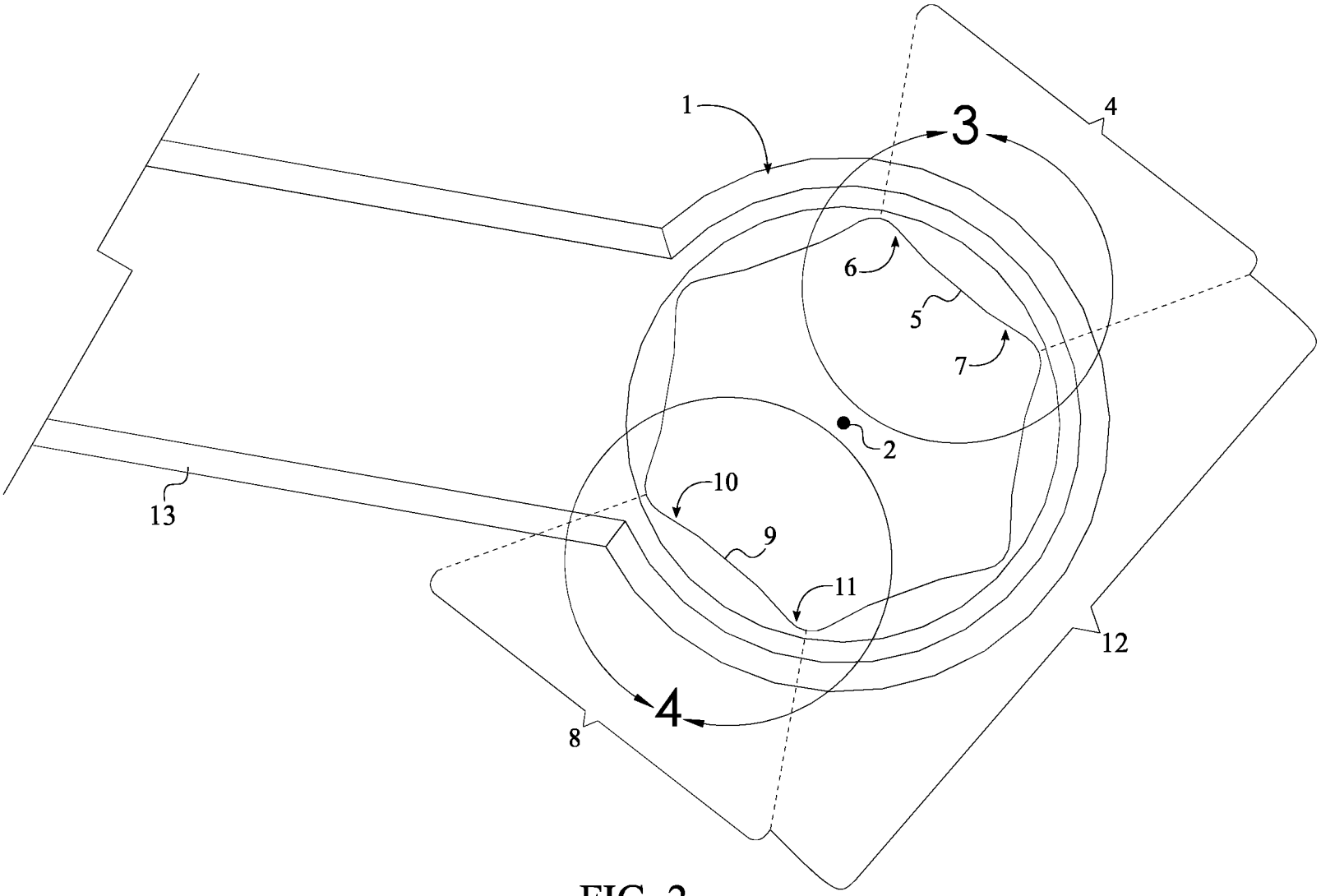
FIG. 2 is a top view of the present invention, which two different detailed views are taken shown in FIG. 3 and FIG. 4.

In reference to FIG. 1, the present invention comprises a torque-tool body 1, at least one pair of diametrically opposing engagement features 3, and at least one intermediate feature 12. The torque-tool body 1 is used as a physical structure to apply torque onto the fastener head. In particular, the wrench torque-tool body 1 is extrusion sized to fit around the male fastener in an interlocking manner. The pair of diametrically opposing engagement features 3 that facilitate interlocking aspect comprises a first opposing feature 4 and a second opposing feature 8. The first opposing feature 4 comprises a first flat-bracing surface 5, a first distal cavity surface 6, and a first proximal cavity surface 7 as shown in FIG. 2. The second opposing feature 8 comprises a second flat-bracing surface 9, a second distal cavity surface 10, and a second proximal cavity surface 11 as shown in FIG. 2. In order to fit around the male fastener and transfer torque, the first opposing feature 4 and the second opposing feature 8 are radially distributed around a rotational axis 2 of the torque-tool body 1. The first opposing feature 4 and the second opposing feature 8 are terminally connected to each other by the intermediate feature 12. Depending upon different embodiments of the present invention, the intermediate feature 12 may function as a structural body that interconnect the first opposing feature 4 and the second opposing feature 8 or function as additional interlocking feature around the male fastener. The torque-tool body 1 is outwardly extended from the first opposing feature 4, the second opposing feature 8, and the intermediate feature 12 as the general tool profile is delineated.

In reference to the first opposing feature 4, the first distal cavity surface 6 and the first proximal cavity surface 7 are oppositely positioned of each other about the first flat-bracing surface 5 thus delineating total length of the first opposing feature 4. More specifically, the first distal cavity surface 6 is terminally connected to the first flat-bracing surface 5. The first proximal cavity surface 7 is terminally connected to the first flat-bracing surface 5, opposite of the first distal cavity surface 6. In reference to the second opposing feature 8, the second distal cavity surface 10 and the second proximal cavity surface 11 are oppositely positioned of each other about the first flat-bracing surface 5 thus delineating total length of the second opposing feature 8. More specifically, the second distal cavity surface 10 is terminally connected to the second flat-bracing surface 9. The second proximal cavity surface 11 is terminally connected to the second flat-bracing surface 9, opposite of the second distal cavity surface 10. Resultantly, the first proximal cavity surface 7 and the second proximal cavity surface 11 are terminally connected to the intermediate feature 12 so that the first opposing feature 4 and the second opposing feature 8 can be oriented away from the intermediate feature 12. In order to maximize applied torque to the male fastener, the first flat-bracing surface 5 and the second flat-bracing surface 9 are positioned parallel to each other. As a result, preferably the first opposing feature 4 is able to bite into one of the lateral walls of the male fastener while the second opposing feature 8 is able to fully press against opposing lateral wall of the male fastener. It is understood that the first opposing feature 4 and the second opposing feature 8 can be orientated in reverse so that the first opposing feature 4 becomes the second opposing feature 8 and the second opposing feature 8 becomes the first opposing feature 4.

In reference to FIG. 1-2, the present invention further comprises a wrench handle 13 so that the user can easily apply torque to the torque-tool body 1. More specifically, the wrench handle 13 is externally and laterally connected to the torque-tool body 1. For an example, when the torque is applied to the wrench handle 13 in the clockwise or counterclockwise direction, the torque-tool body 1 is also able to simultaneously rotate with the wrench handle 13 thus transferring the applied torque to the male fastener. However, the components and configurations of the present invention may further adapt to a socket wrench.

In reference to an opened-end wrench embodiment of the present invention, the intermediate feature 12 is generally a concave surface that traverses into the torque-tool body 1. Furthermore, a receiver opening is delineated in between the first opposing feature 4 and the second opposing feature 8 and oppositely positioned of the intermediate feature 12. As a result, the opened-end wrench embodiment can be externally engaged around the male fastener that need to be removed or tighten through the receiver opening. Once the opened-end wrench is pressed against the male fastener, the first opposing feature 4 and the second opposing feature 8 are able to apply torque to male fastener and the intermediate feature 12 is able to structurally strengthen the configuration of the first opposing feature 4 and the second opposing feature 8. Preferably, the second opposing feature 8 is a smooth surface.

In reference to a boxed-end wrench embodiment of the present invention, the intermediate feature 12 is generally a pair of engagement features that is a combination of the first opposing feature 4 and the second opposing feature 8. Furthermore, a receiver opening is delineated normal to the torque-tool body 1. As a result, the boxed-end wrench embodiment can be axially engaged around the male fastener that need to be removed or tighten through the receiver opening. Once the boxed-end wrench is pressed against the male fastener, the first opposing feature 4, the second opposing feature 8 are, and the intermediate feature 12 able to collectively apply torque to male fastener while the intermediate feature 12 is also able to structurally strengthen the configuration of the first opposing feature 4 and the second opposing feature 8. Preferably, the second opposing feature 8 is a smooth surface.

Figure 3:
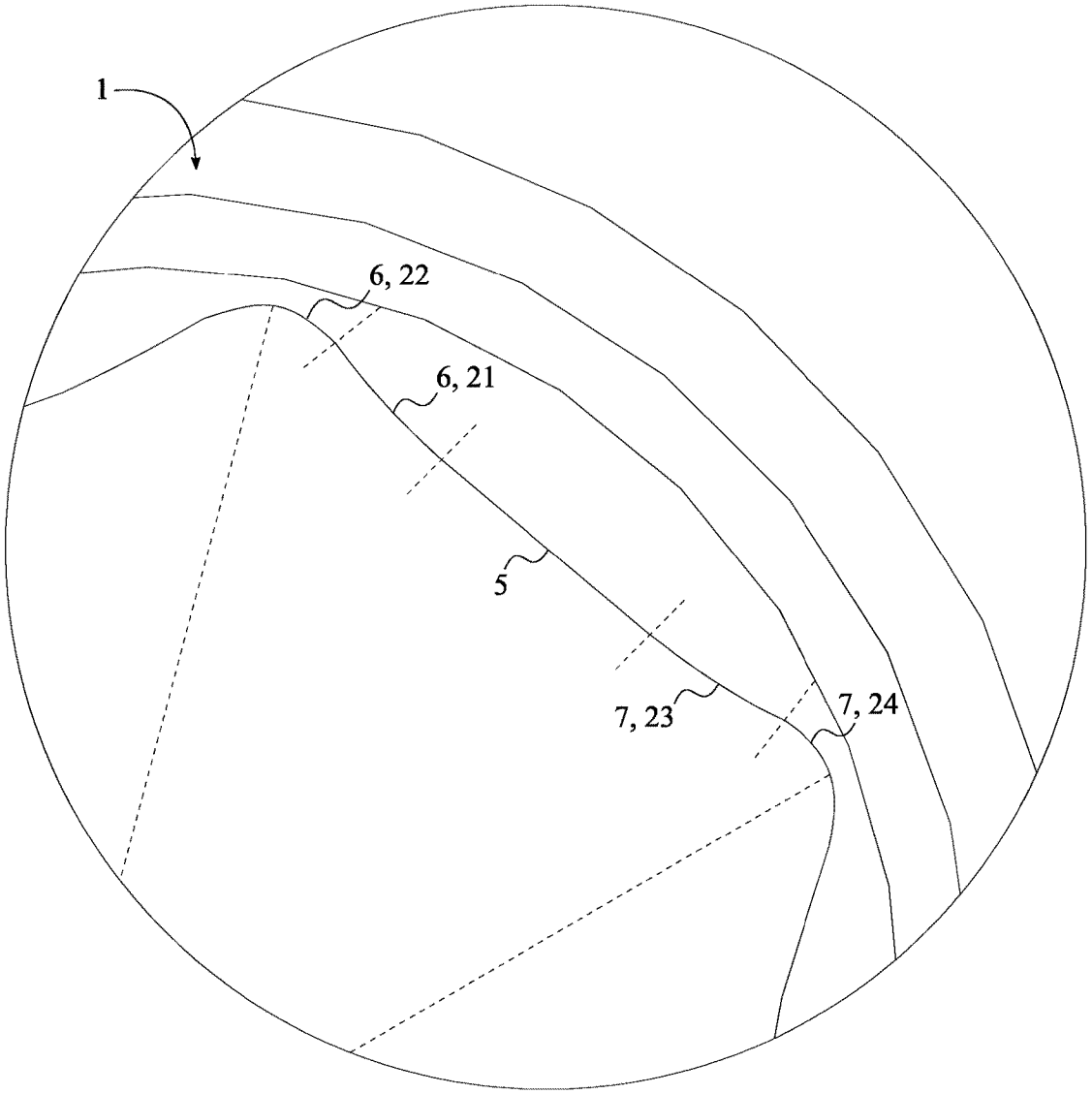
FIG. 3 is a detailed view for the first configuration of the first opposing feature.

In reference to a first configuration of the first opposing feature 4, the first distal cavity surface 6 comprises a first distal convex section 21 and a first distal arc section 22 as shown in FIG. 1-4. More specifically, the first distal convex section 21 and the first distal arc section 22 are adjacently connected to each other thus delineating the general shape of the first distal cavity. The first proximal cavity surface 7 comprises a first proximal convex section 23 and a first proximal arc section 24 as shown in FIG. 3.

Furthermore, the first proximal convex section 23 and the first proximal arc section 24 are adjacently connected to each other thus delineating the general shape of the first proximal cavity. In reference to the overall shape of the first opposing feature 4, the first distal convex section 21 and the first proximal convex section 23 are oppositely positioned of each other about the first flat-bracing surface 5. As a result, the first distal convex section 21 is terminally connected to the first flat-bracing surface 5 from one end. The first proximal convex section 23 is terminally connected to the first flat-bracing surface 5 from opposite end. The arc of the first distal convex section 21 and/or the first proximal convex section 23 are a first radius that is equal to a range of 0.9 to 1.5 times a total perpendicular distance between the first opposing feature 4 and the second opposing feature 8. A radius of the first distal convex section 21 and the first proximal convex section 23 are greater than a radius of the first distal arc section 22 and the first proximal arc section 24. The first distal convex section 21 and the first proximal convex section 23 may be connected to the first flat-bracing surface 5 by a small radius section.

In reference to the first configuration of the first opposing feature 4, as shown in FIG. 3, an arc length of the first distal convex section 21 ranges from 15%-25% of a total length of the first opposing feature 4. Preferably, the arc length of the first distal convex section 21 ranges from 20%-22% of the total length of the first opposing feature 4. An arc length of the first proximal convex section 23 ranges from 15%-25% of the total length of the first opposing feature 4. Preferably, the arc length of the first proximal convex section 23 ranges from 20%-22% of the total length of the first opposing feature 4. Furthermore, the arc length of the first distal convex section 21 and the first proximal convex section 23 are equal to each other thus delineating symmetric profiles. However, the arc length of the first distal convex section 21 and the arc length of the first proximal convex section 23 may be of different lengths and thus not symmetrical. A length of the first flat-bracing surface 5 ranges from 30%-60% of the total length of the first opposing feature 4 to provide a maximum torque applying surface area. Preferably, the length of the first flat-bracing surface 5 ranges from 35%-45% of the total length of the first opposing feature 4.

In reference to the first configuration of the first opposing feature 4, the present invention further comprise a set of serrations 41. The set of serrations 41 provides a gripping points to either side of the male fastener and laterally traverses into the torque-tool body 1 from the first flat-bracing surface 5. The depth of the set of serrations 41 may be offset from the starting point of first distal arc section 22 and the first proximal arc section 24.

In reference to a second configuration of the first opposing feature 4, the first distal cavity surface 6 comprises a first distal angled section 31, a first distal concave section 32, and a first distal arc section 22 as shown in FIG. 5-8. More specifically, the first distal angled section 31 and the first distal arc section 22 are oppositely positioned of each other about the first distal concave section 32. The first distal angled section 31 and the first distal arc section 22 are terminally connected to the first distal concave section 32 thus delineating the general shape of the first distal cavity. The first proximal cavity surface 7 comprises a first proximal angled section 34, a first proximal concave section 35, and a first proximal arc section 24 as shown in FIG. 5-8. Furthermore, the first proximal angled section 34 and the first proximal arc section 24 are oppositely positioned of each other about the first proximal concave section 35. The first proximal angled section 34 and the first proximal arc section 24 are terminally connected to the first proximal concave section 35 thus delineating the general shape of the first proximal cavity. In reference to the overall shape of the first opposing feature 4, the first distal angled section 31 and the first proximal angled section 34 are oppositely positioned of each other about the first flat-bracing surface 5. As a result, the first distal angled section 31 is terminally connected to the first flat-bracing surface 5 at a first obtuse angle 61. The first proximal angled section 34 is terminally connected to the first flat-bracing surface 5 at the first obtuse angle 61. The first obtuse angle 61 ranges from 91 degrees to 165 degrees. Preferably, the first obtuse angle 61 is about 160 degrees.

In reference to the second configuration of the first opposing feature 4 the length of the first flat-bracing surface 5 ranges from 30%-60% of the total length of the first opposing feature 4. Preferably, the length of the first flat-bracing surface 5 ranges from 35%-45% of the total length of the first opposing feature 4. A length of the first distal angled section 31 ranges from 15%-25% of the length of the first flat-bracing surface 5. Preferably, the length of the first distal angled section 31 ranges from 18%-22% of the length of the first flat-bracing surface 5. A length of the first proximal angled section 34 ranges from 15%-25% of the length of the first flat-bracing surface 5. Preferably, the length of the first proximal angled section 34 ranges from 18%-22% of the length of the first flat-bracing surface 5. Furthermore, the length of the first distal angled section 31 and the first proximal angled section 34 are equal to each other thus delineating symmetric profiles. However, the length of the first distal angled section 31 and the length of the first proximal angled section 34 may be of different lengths and thus not symmetrical.

In reference to a third configuration of the first opposing feature 4, the first distal cavity surface 6 comprises the first distal angled section 31, the first distal concave section 32, and the first distal arc section 22 as shown in FIG. 9-12. More specifically, the first distal angled section 31 and the first distal arc section 22 are oppositely positioned of each other about the first distal concave section 32. The first distal angled section 31 and the first distal arc section 22 are terminally connected to the first distal concave section 32 thus delineating the general shape of the first distal cavity. The first proximal cavity surface 7 comprises the first proximal angled section 34, the first proximal concave section 35, and the first proximal arc section 24 as shown in FIG. 9-12. Furthermore, the first proximal angled section 34 and the first proximal arc section 24 are oppositely positioned of each other about the first proximal concave section 35. The first proximal angled section 34 and the first proximal arc section 24 are terminally connected to the first proximal concave section 35 thus delineating the general shape of the first proximal cavity. In reference to the overall shape of the first opposing feature 4, the first distal angled section 31 and the first proximal angled section 34 are oppositely positioned of each other about the first flat-bracing surface 5. As a result, the first distal angled section 31 is terminally connected to the first flat-bracing surface 5 at a second obtuse angle 62. The first proximal angled section 34 is terminally connected to the first flat-bracing surface 5 at the second obtuse angle 62. The second obtuse angle 62 ranges from 91 degrees to 165 degrees. Preferably, the second obtuse angle 62 is about 160 degrees. The first distal angled section 31 and the first proximal angled section 34 may be connected to the first flat-bracing section 5 by a small radial section. The set of serrations 41 that provides gripping points to either side of the male fastener is laterally traverses into the torque-tool body 1 from the first flat-bracing surface 5 and further defines the third configuration of the first opposing feature 4, wherein the depth of the set of serrations 41 may be offset from the starting point of first distal arc section 22 and the first proximal arc section 24. The serrations 41 may be further offset from an intersecting point 100 that is positioned in between the first distal angled section 31 and the first flat-bracing surface 5 by a first length. The set of serrations 41 may be further offset from the intersecting point 101 that is positioned in between the first proximal angled section 34 and the first flat-bracing surface 5 by a second length. The first length and the second length may be the equal to each other or different from each other depending upon user preference. The set of serrations 41 may further be described as disturbances.

In reference to the third configuration of the first opposing feature 4 the length of the first flat-bracing surface 5 ranges from 30%-60% of the total length of the first opposing feature 4. Preferably, the length of the first flat-bracing surface 5 ranges from 35%-45% of the total length of the first opposing feature 4. A length of the first distal angled section 31 ranges from 15%-25% of the length of the first flat-bracing surface 5. Preferably, the length of the first distal angled section 31 ranges from 18%-22% of the length of the first flat-bracing surface 5. A length of the first proximal angled section 34 ranges from 15%-25% of the length of the first flat-bracing surface 5. Preferably, the length of the first proximal angled section 34 ranges from 18%-22% of the length of the first flat-bracing surface 5. Furthermore, the length of the first distal angled section 31 and the first proximal angled section 34 are equal to each other thus delineating symmetric profiles. However, the length of the first distal angled section 31 and the length of the first proximal angled section 34 may be different lengths and thus not symmetrical.

In reference to a fourth configuration of the first opposing feature 4, the first distal cavity surface 6 comprises the first distal angled section 31 and the first distal arc section 22 as shown in FIG. 13-16. More specifically, the first distal angled section 31 and the first distal arc section 22 are adjacently connected to each other thus delineating the general shape of the first distal cavity. The first proximal cavity surface 7 comprises the first proximal angled section 34 and the first proximal arc section 24 as shown in FIG. 13-16. Furthermore, the first proximal angled section 34 and the first proximal arc section 24 are adjacently connected to each other thus delineating the general shape of the first proximal cavity. In reference to the overall shape of the first opposing feature 4, the first distal angled section 31 and the first proximal angled section 34 are oppositely positioned of each other about the first flat-bracing surface 5. As a result, the first distal angled section 31 is terminally connected to the first flat-bracing surface 5 at a third obtuse angle 63. The first proximal angled section 34 is terminally connected to the first flat-bracing surface 5 at the third obtuse angle 63. The third obtuse angle 63 ranges from 91 degrees to 165 degrees. Preferably, the third obtuse angle 63 is about 160 degrees.

In reference to a fifth configuration of the first opposing feature 4, the first distal cavity surface 6 comprises the first distal angled section 31 and the first distal arc section 22 as shown in FIG. 17-20. More specifically, the first distal angled section 31 and the first distal arc section 22 are adjacently connected to each other thus delineating the general shape of the first distal cavity. The first proximal cavity surface 7 comprises the first proximal angled section 34 and the first proximal arc section 24 as shown in FIG. 17-20. Furthermore, the first proximal angled section 34 and the first proximal arc section 24 are adjacently connected to each other thus delineating the general shape of the first proximal cavity. In reference to the overall shape of the first opposing feature 4, the first distal angled section 31 and the first proximal angled section 34 are oppositely positioned of each other about the first flat-bracing surface 5. As a result, the first distal angled section 31 is terminally connected to the first flat-bracing surface 5 at a fourth obtuse angle 64. The first proximal angled section 34 is terminally connected to the first flat-bracing surface 5 at the fourth obtuse angle 64. The fourth obtuse angle 64 ranges from 91 degrees to 165 degrees. Preferably, the fourth obtuse angle 64 is about 160 degrees. The set of serrations 41 that provides gripping points to either side of the male fastener is laterally traverses into the torque-tool body 1 from the first flat-bracing surface 5 further defining the fifth configuration of the first opposing feature 4, wherein the depth of the set of serrations 41 may be offset from the starting point of first distal arc section 22 and the first proximal arc section 24. The first distal angled section 31 and the first proximal angled section 34 may be connected to the first flat-bracing section by a small radial section.

The set of serrations 41 provides a gripping points to either side of the male fastener and laterally traverses into the torque-tool body 1 from the first flat-bracing surface 5. The depth of the set of serrations 41 may be offset from the starting point of first distal arc section 22 and the first proximal arc section 24. The serrations 41 may be further offset from an intersecting point 100 that is positioned in between the first distal angled section 31 and the first flat-bracing surface 5 by a first length 101. The set of serrations 41 may be further offset from the intersecting point 102 that is positioned in between the first proximal angled section 34 and the first flat-bracing surface 5 by a second length 103. The first length 101 and the second length 103 may be the equal to each other or different from each other depending upon user preference. The set of serrations 41 may further be described as disturbances.

Figure 4:
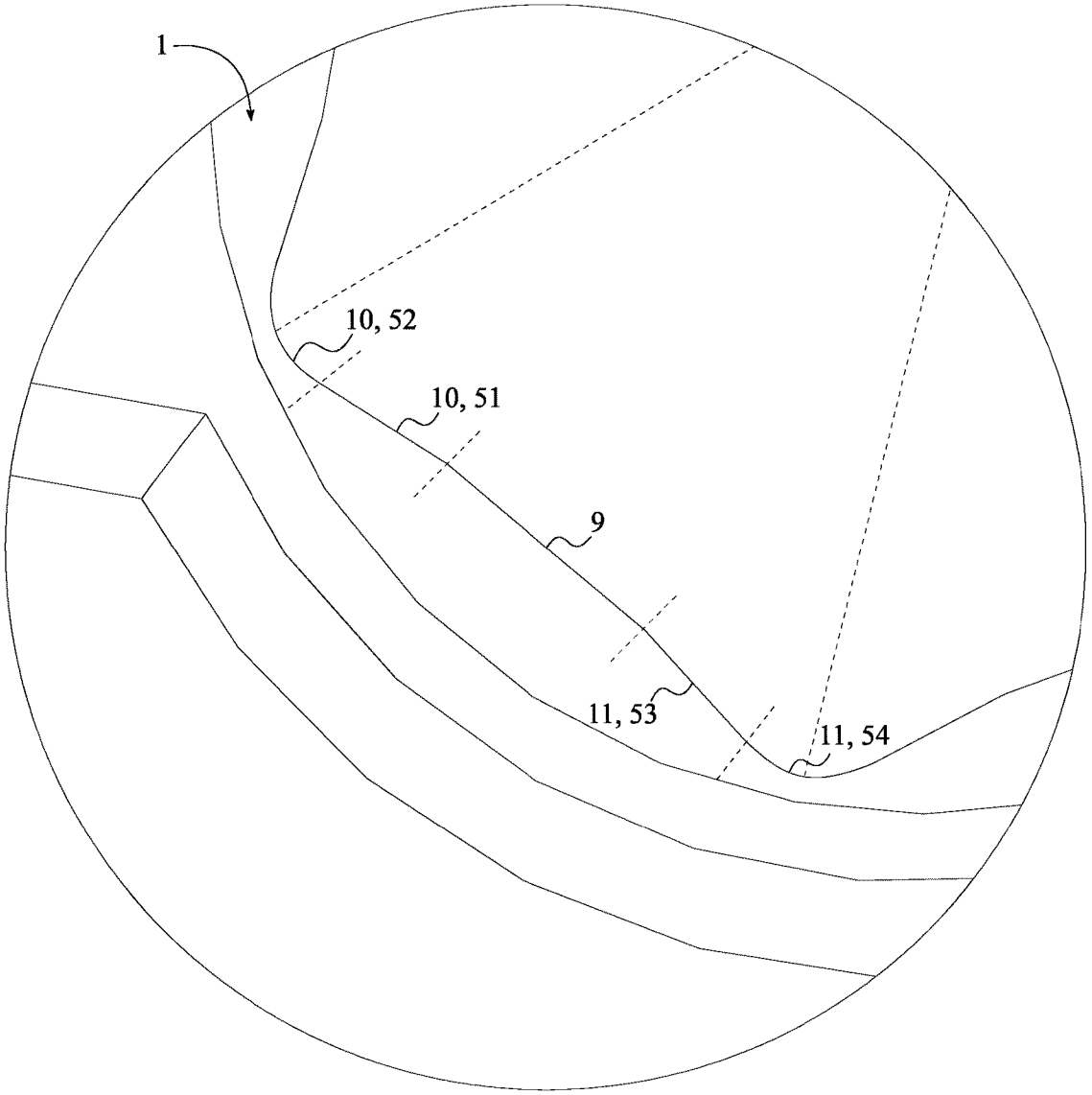
FIG. 4 is a detailed view for the first configuration of the second opposing feature.
Figure 5:
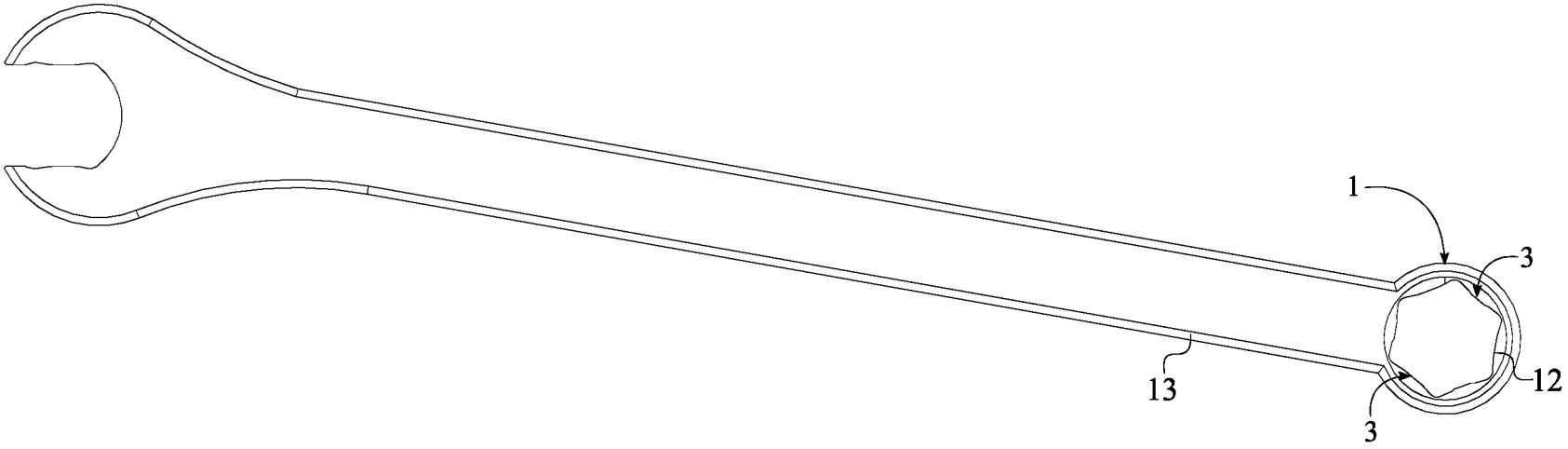
FIG. 5 is a top view of another embodiment of the present invention.
Figure 6:
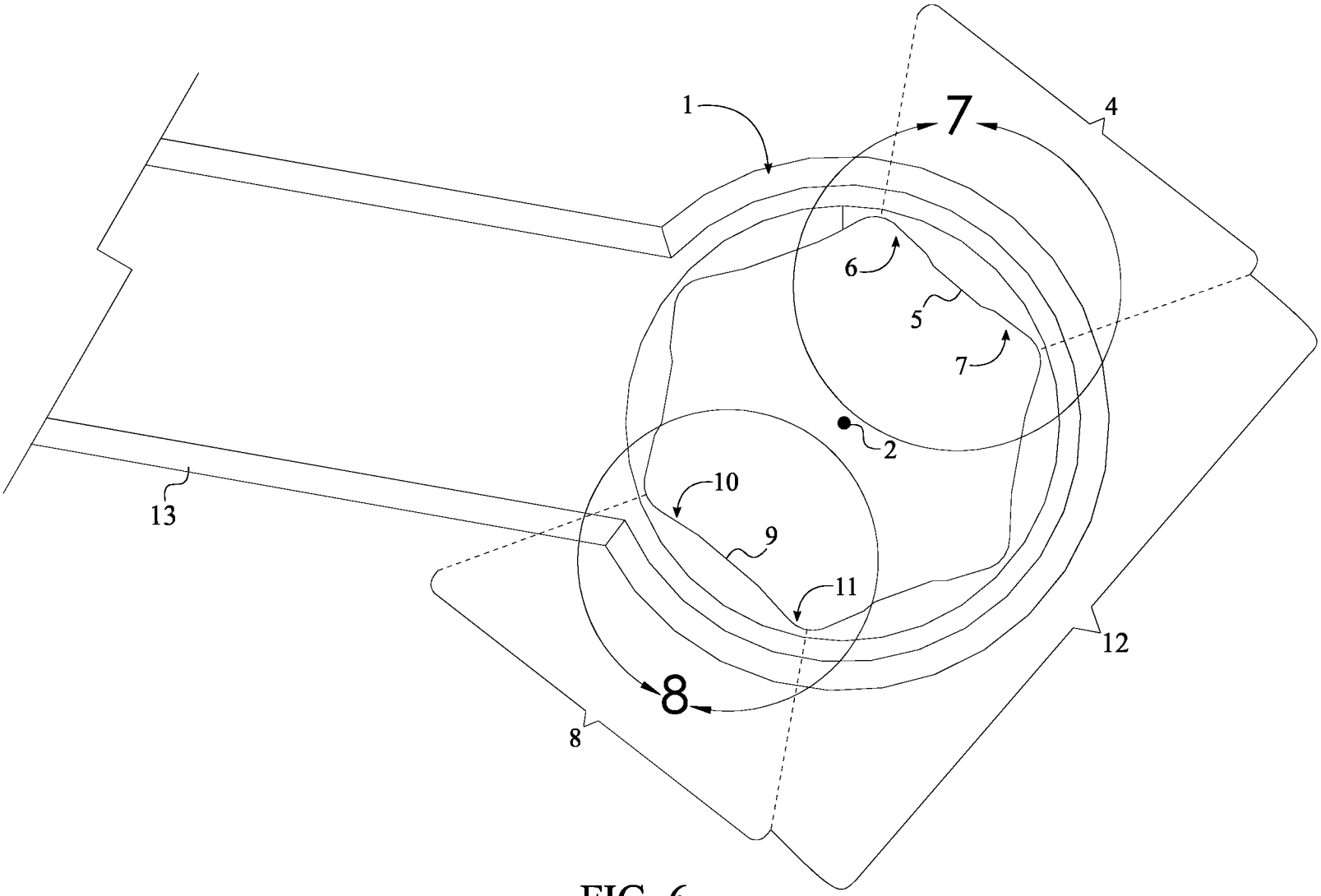
FIG. 6 is a top view of the present invention, which two different detailed views are taken shown in FIG. 7 and FIG. 8.
Figure 7:
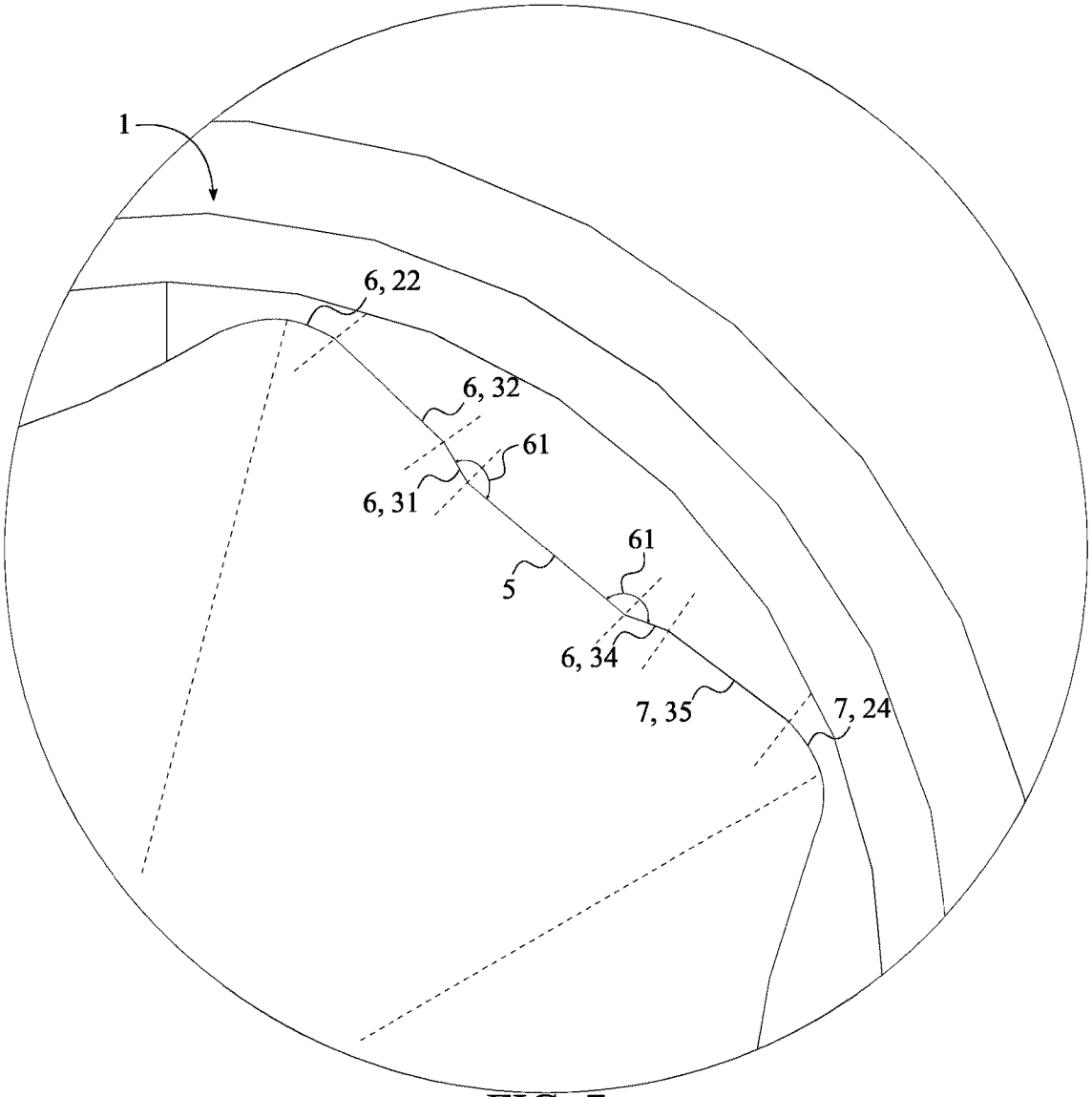
FIG. 7 is a detailed view for the second configuration of the first opposing feature.
Figure 8:
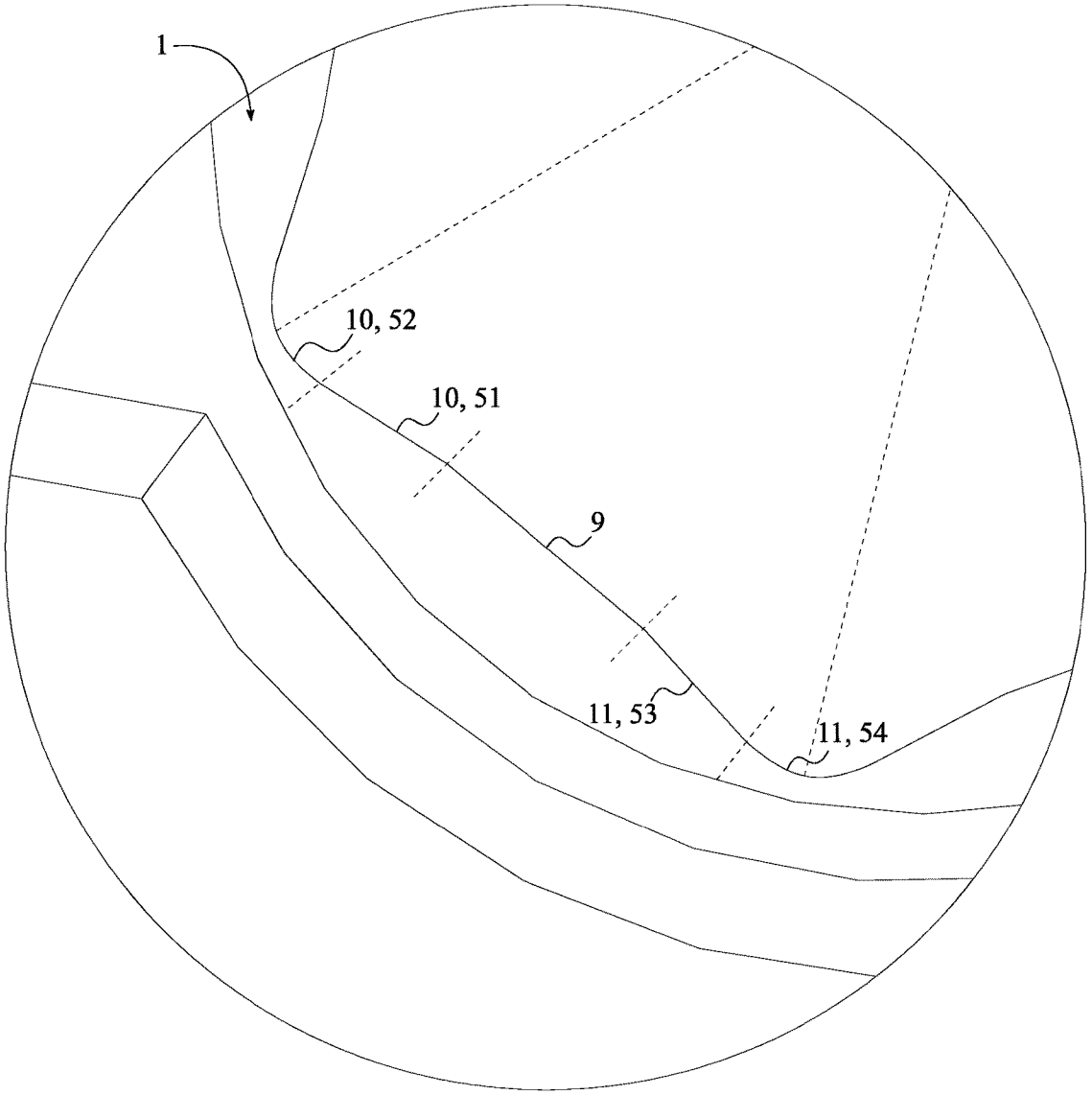
FIG. 8 is a detailed view for the first configuration of the second opposing feature.
Figure 9:
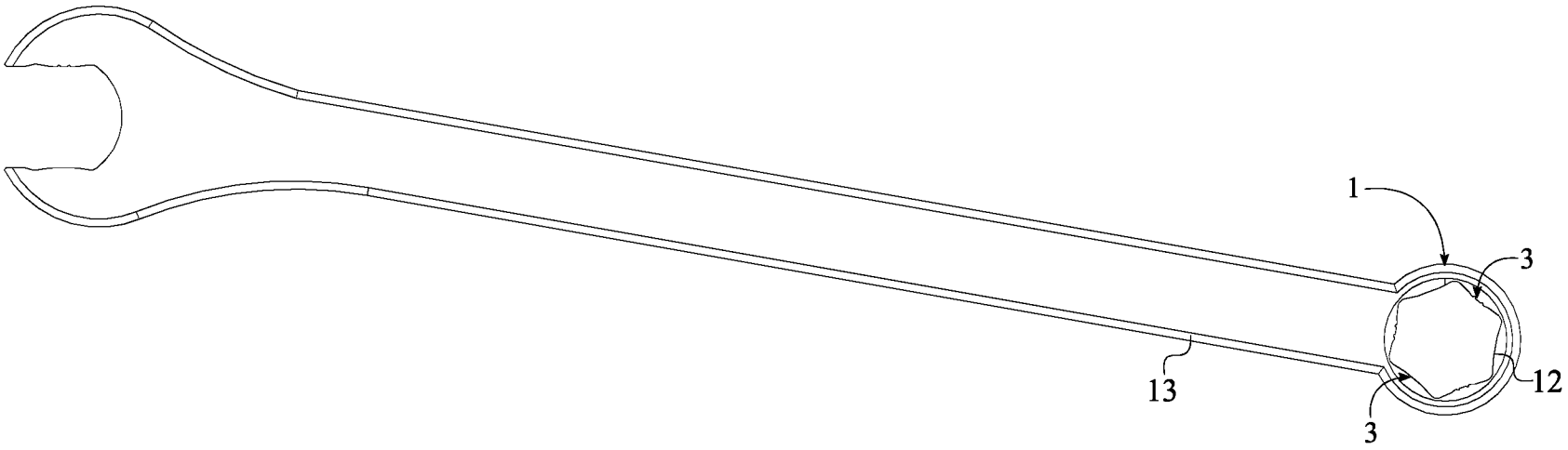
FIG. 9 is a top view of another embodiment of the present invention.
Figure 10:
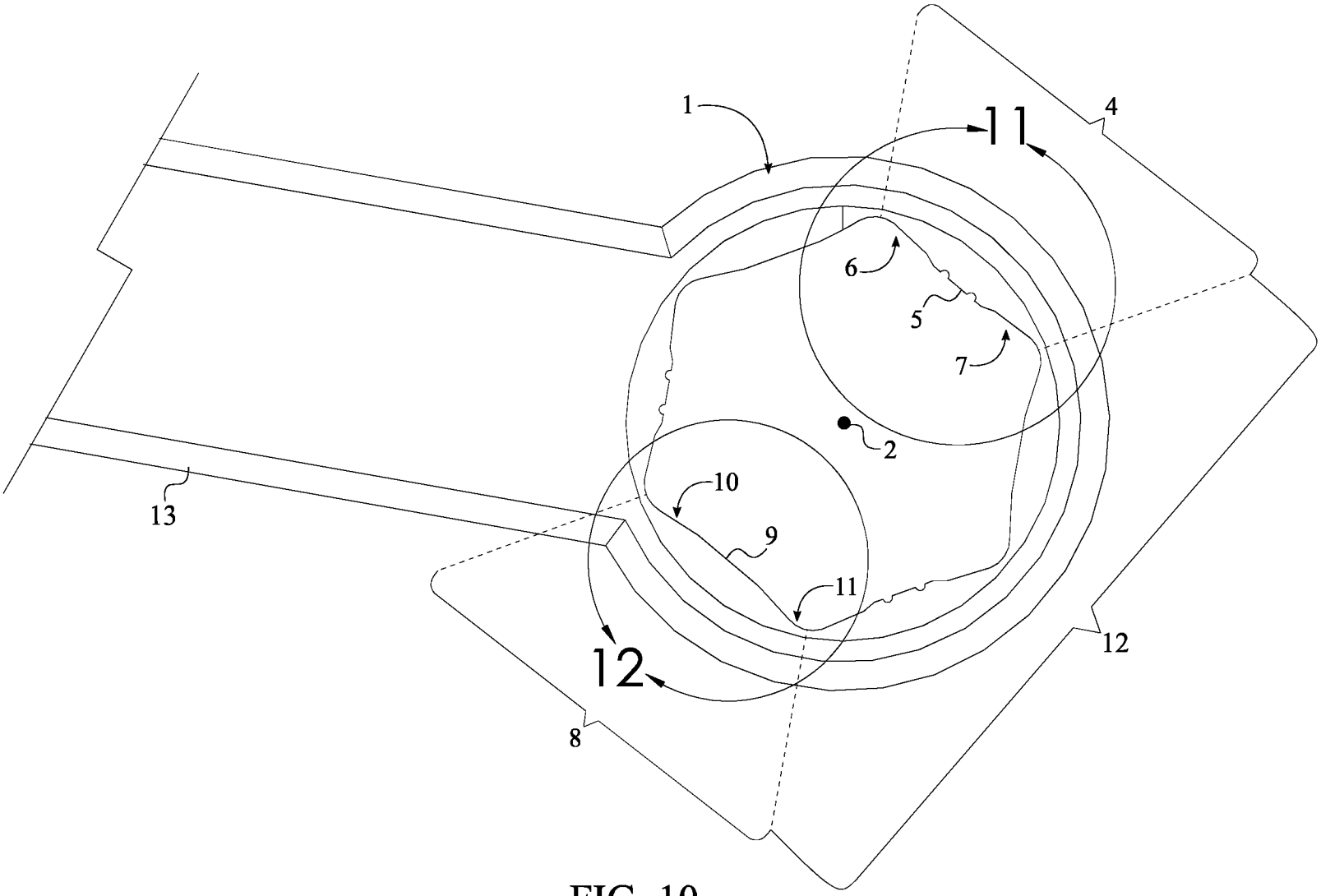
FIG. 10 is a top view of the present invention, which two different detailed views are taken shown in FIG. 11 and FIG. 12.
Figure 11:
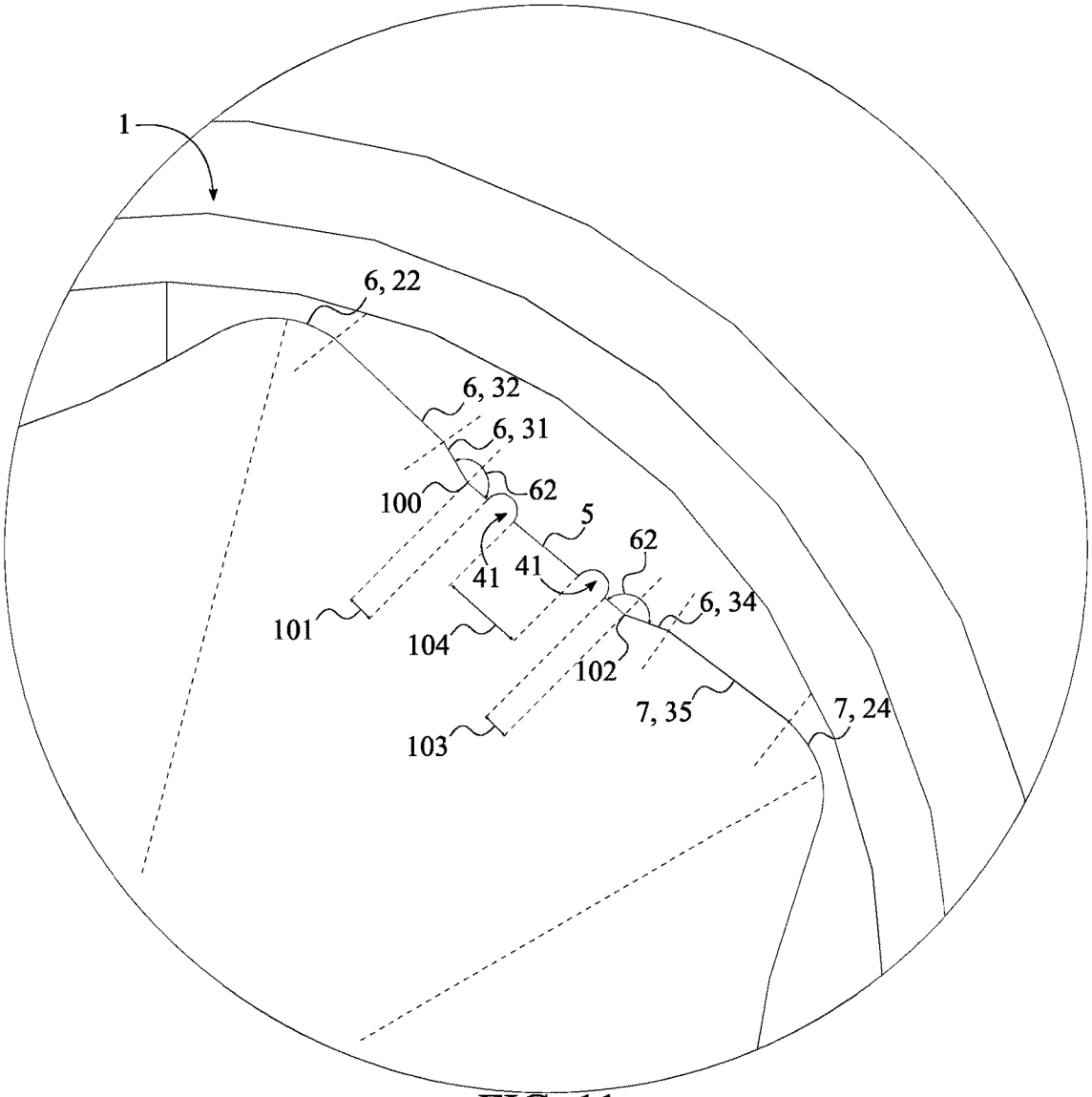
FIG. 11 is a detailed view for the third configuration of the first opposing feature.
Figure 12:
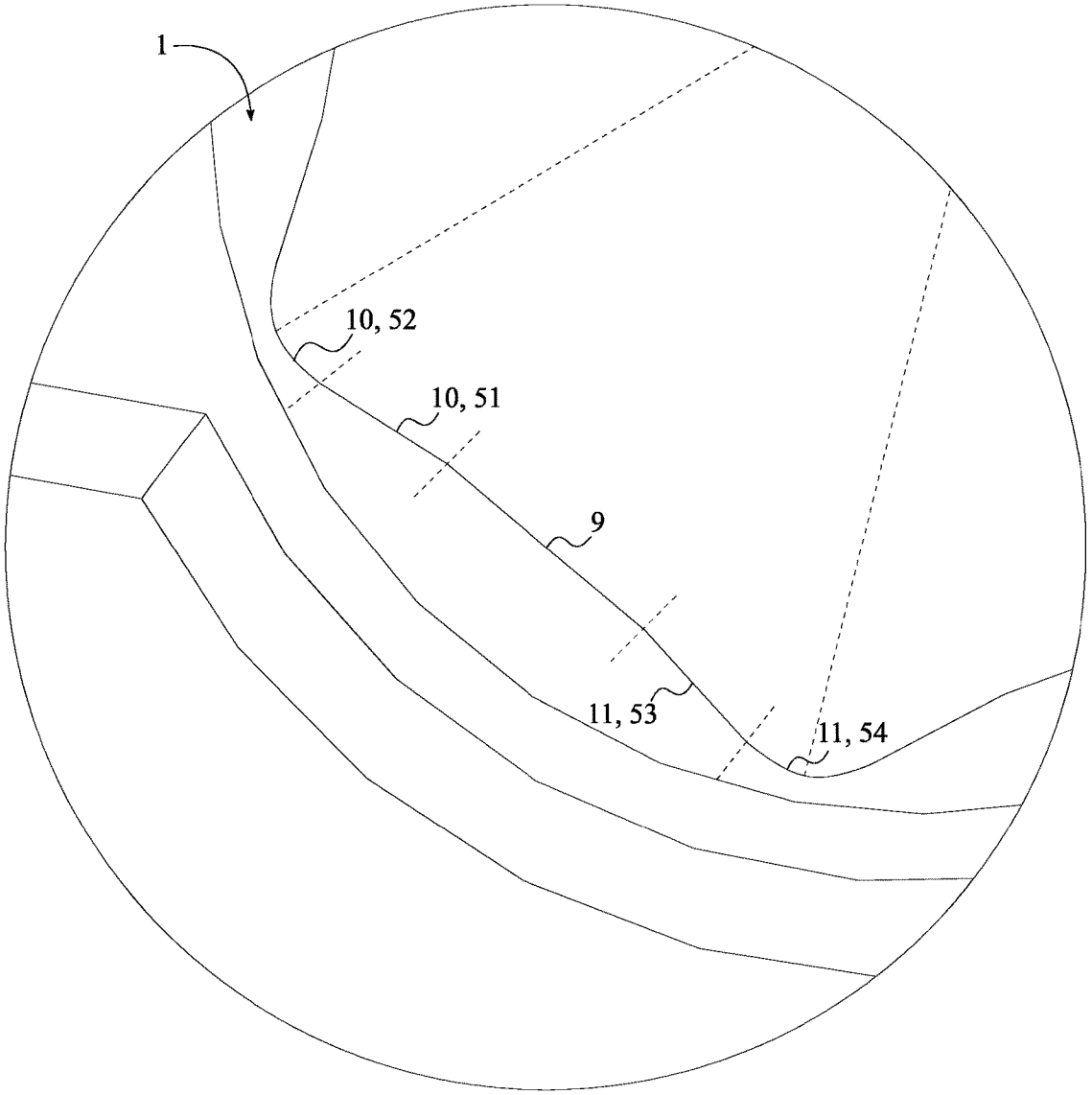
FIG. 12 is a detailed view for the first configuration of the second opposing feature.
Figure 13:
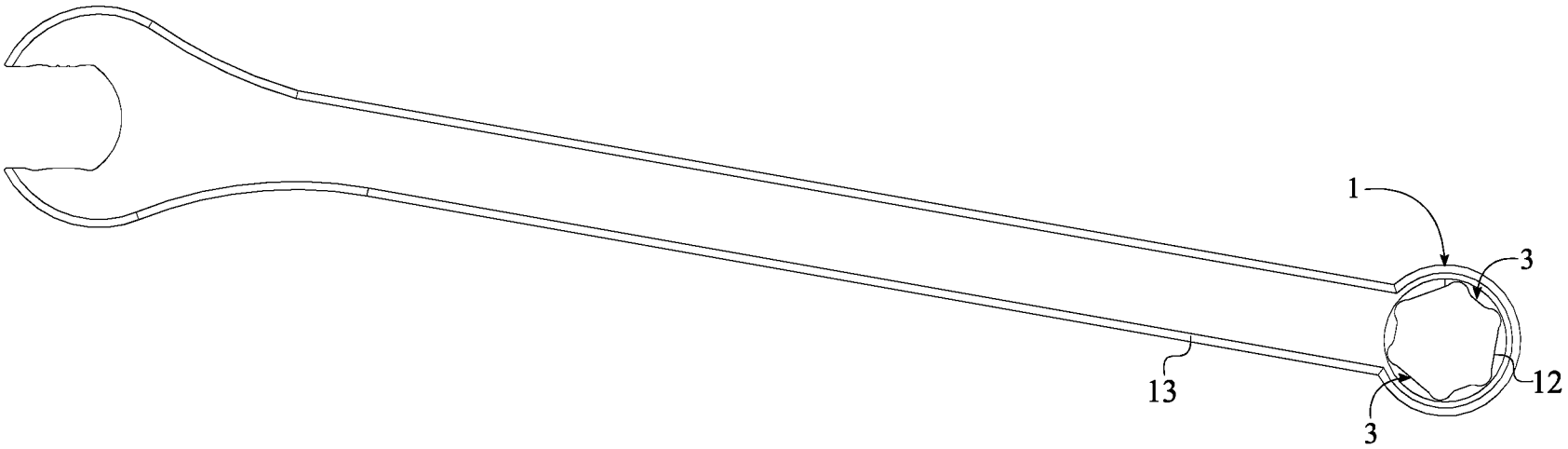
FIG. 13 is a top view of another embodiment of the present invention.
Figure 14:
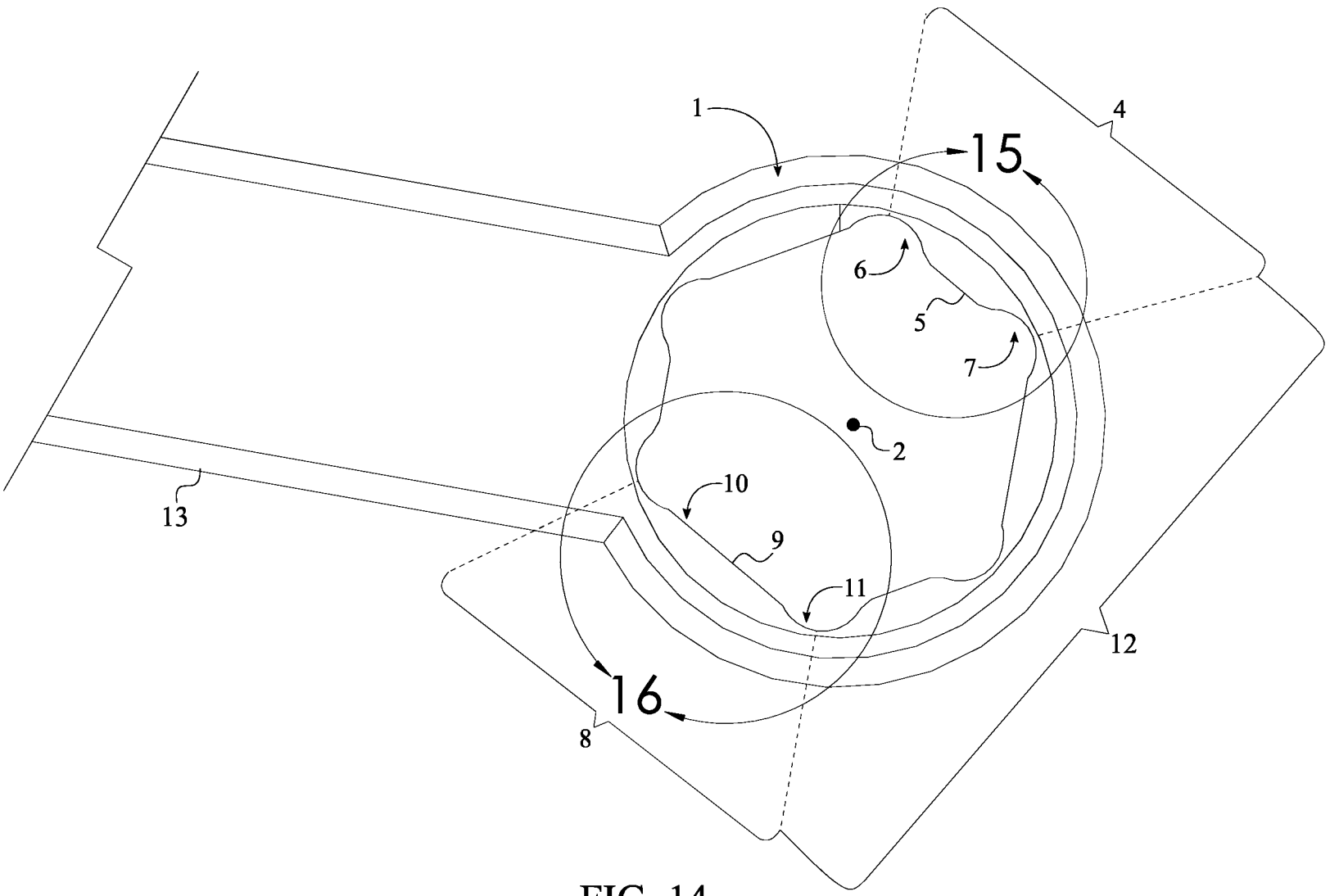
FIG. 14 is a top view of the present invention, which two different detailed views are taken shown in FIG. 15 and FIG. 16.
Figure 15:
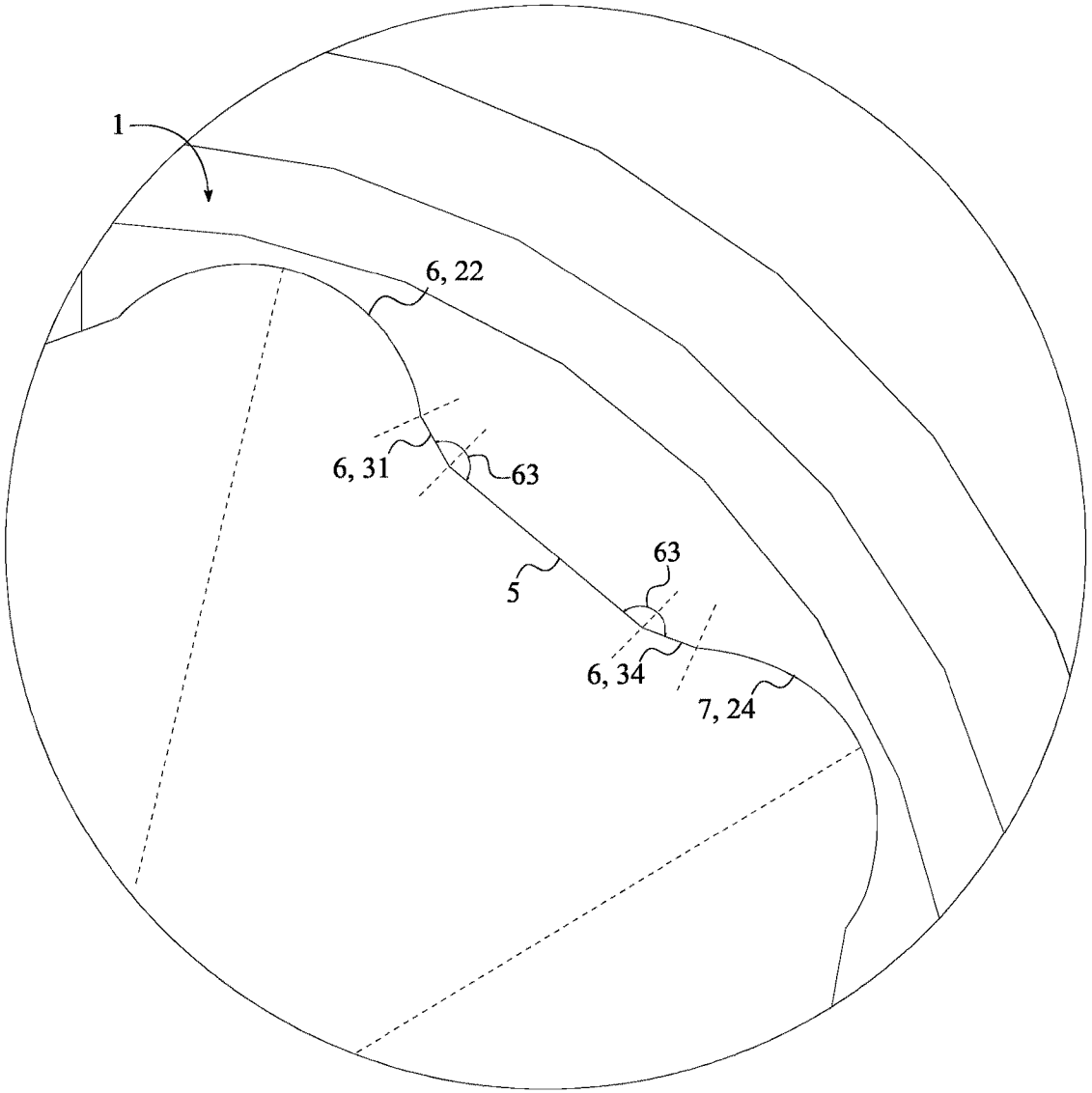
FIG. 15 is a detailed view for the fourth configuration of the first opposing feature.

In reference to first configuration of the second opposing feature 8, the second distal cavity surface 10 comprises a second distal convex section 51 and a second distal arc section 52 as shown in FIG. 4, FIG. 8, and FIG. 12. More specifically, the second distal convex section 51 and the second distal arc section 52 are adjacently connected to each other thus delineating the general shape of the second distal cavity. The second proximal cavity surface 11 comprises a second proximal convex section 53 and a second proximal arc section 54 as shown in FIG. 4, FIG. 8, and FIG. 12. Furthermore, the second proximal convex section 53 and the second proximal arc section 54 are adjacently connected to each other thus delineating the general shape of the second proximal cavity. In reference to the overall shape of the second opposing feature 8, the second distal convex section 51 and the second proximal convex section 53 are oppositely positioned of each other about the second flat-bracing surface 9. As a result, the second distal convex section 51 is terminally connected to the second flat-bracing surface 9 from one end. The second proximal convex section 53 is terminally connected to the second flat-bracing surface 9 from opposite end. In other words, the first configuration of the second opposing feature 8 is exactly similar to the first configuration of the first opposing feature 4 with reference to the components and their configurations. The second flat-bracing surface 9 may be a radius surface. The length of the second distal convex section 51 and the length of the second proximal convex section 53 may be equidistant to each other or different from each other. For example, when the lengths of the second distal convex section 51 and the length of the second proximal convex section 53 are equal to each other, the second flat-bracing surface 9 is centered within the second opposing feature 8. When the lengths of the second distal convex section 51 and the length of the second proximal convex section 53 different from one another, the second flat-bracing surface 9 is off-centered within the second opposing feature 8.

The arc of the second distal convex section 51 and/or the second proximal convex section 53 are a first radius that is equal to a range of 0.9 to 1.5 times a total perpendicular distance between the first opposing feature 4 and the second opposing feature 8. A radius of the second distal convex section 51 and the second proximal convex section 53 are greater than a radius of the second distal arc section 52 and the second proximal arc section 54. The second distal convex section 51 and the second proximal convex section 53 may be connected to the second flat-bracing surface 9 by a small radius section.

In reference to the first configuration of the second opposing feature 8, as shown in FIG. 12, an arc length of the second distal convex section 51 ranges from 15%-25% of a total length of the second opposing feature 8. Preferably, the arc length of the second distal convex section 51 ranges from 20%-22% of the total length of the second opposing feature 8. An arc length of the second proximal convex section 53 ranges from 15%-25% of the total length of the second opposing feature 8. Preferably, the arc length of the second proximal convex section 53 ranges from 20%-22% of the total length of the second opposing feature 8. Furthermore, the arc length of the second distal convex section 51 and the second proximal convex section 53 are equal to each other thus delineating symmetric profiles. However, the arc length of the second distal convex section 51 and the arc length of the second proximal convex section 53 may be of different lengths and thus not symmetrical. A length of the second flat-bracing surface 9 ranges from 30%-60% of the total length of the second opposing feature 8 to provide a maximum torque applying surface area. Preferably, the length of the second flat-bracing surface 9 ranges from 35%-45% of the total length of the second opposing feature 8.

Figure 16:
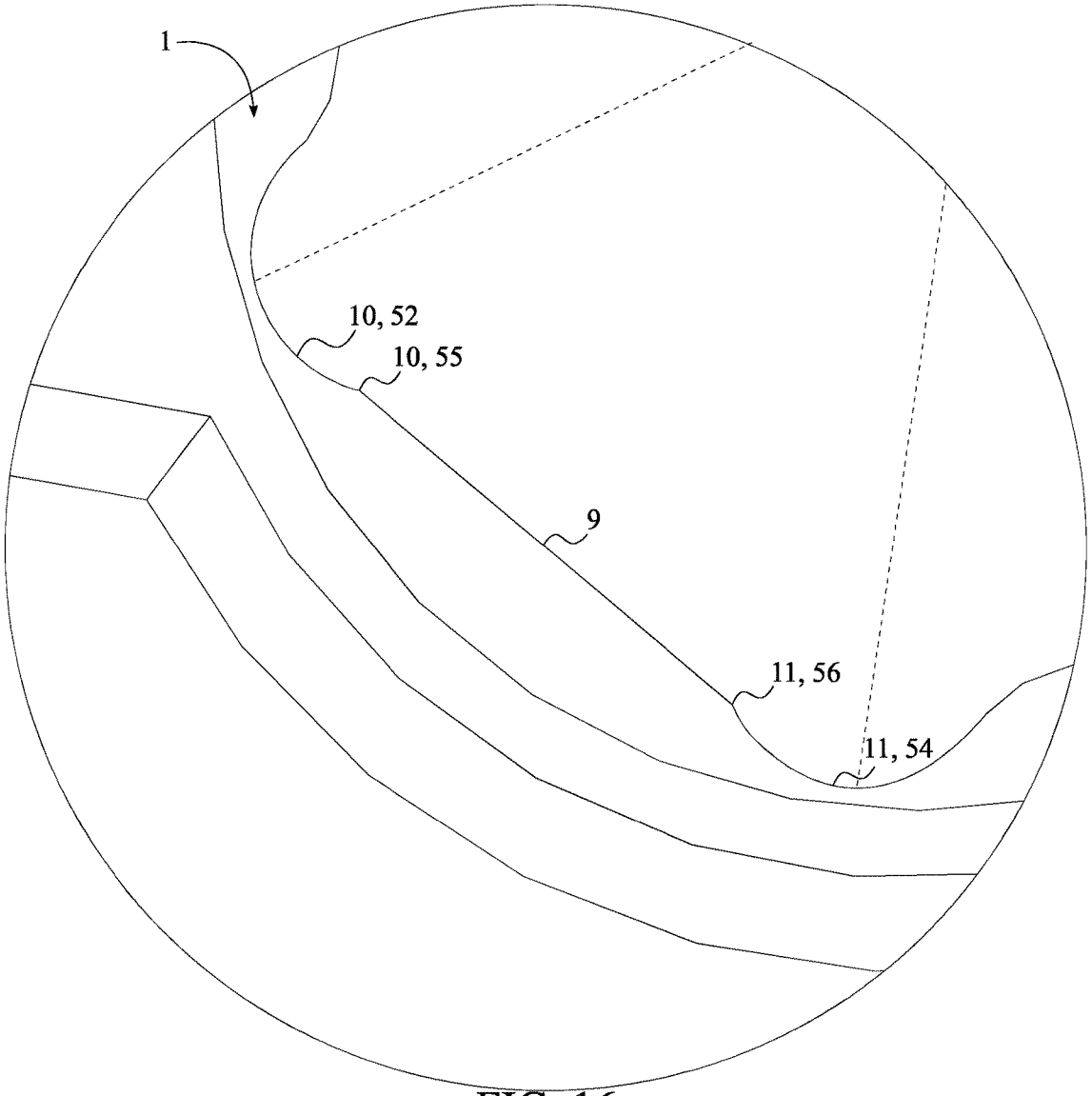
FIG. 16 is a detailed view for the second configuration of the second opposing feature.
Figure 17:
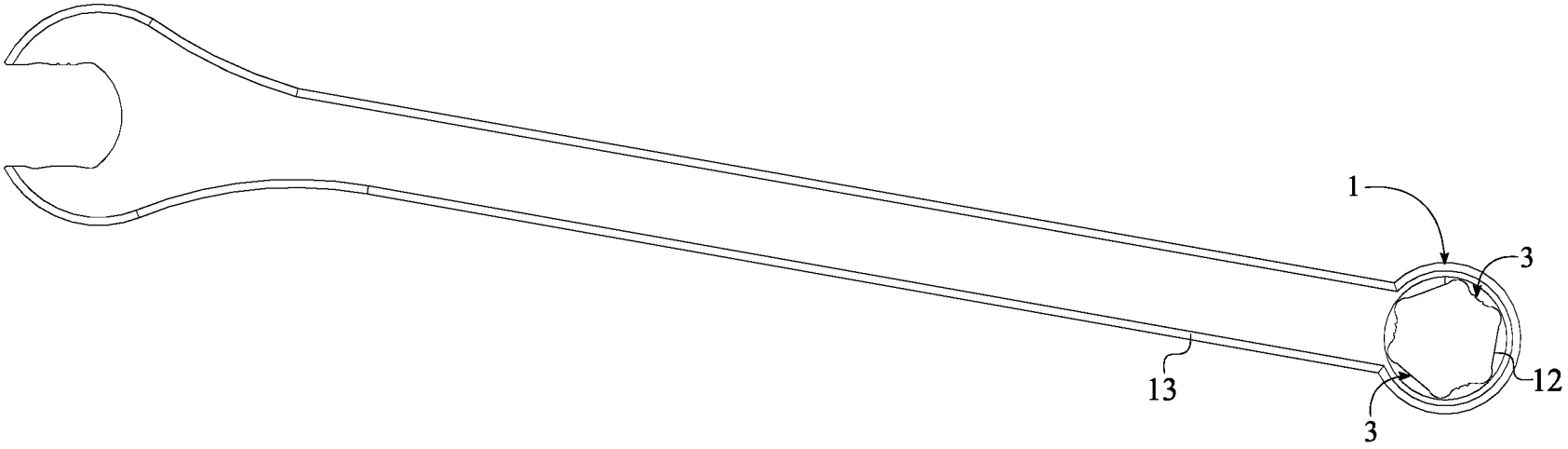
FIG. 17 is a top view of another embodiment of the present invention.
Figure 18:
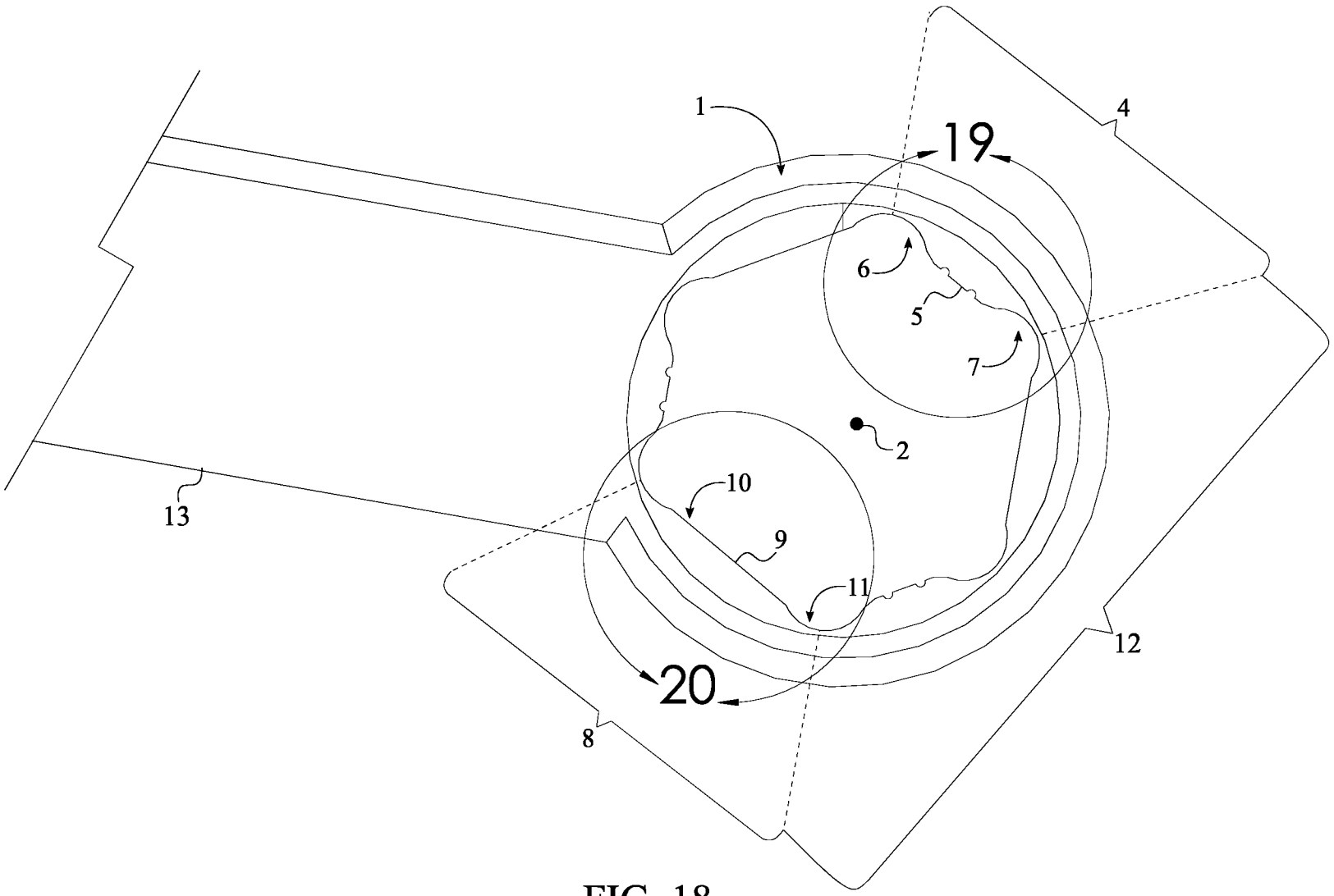
FIG. 18 is a top view of the present invention, which two different detailed views are taken shown in FIG. 19 and FIG. 20.
Figure 19:
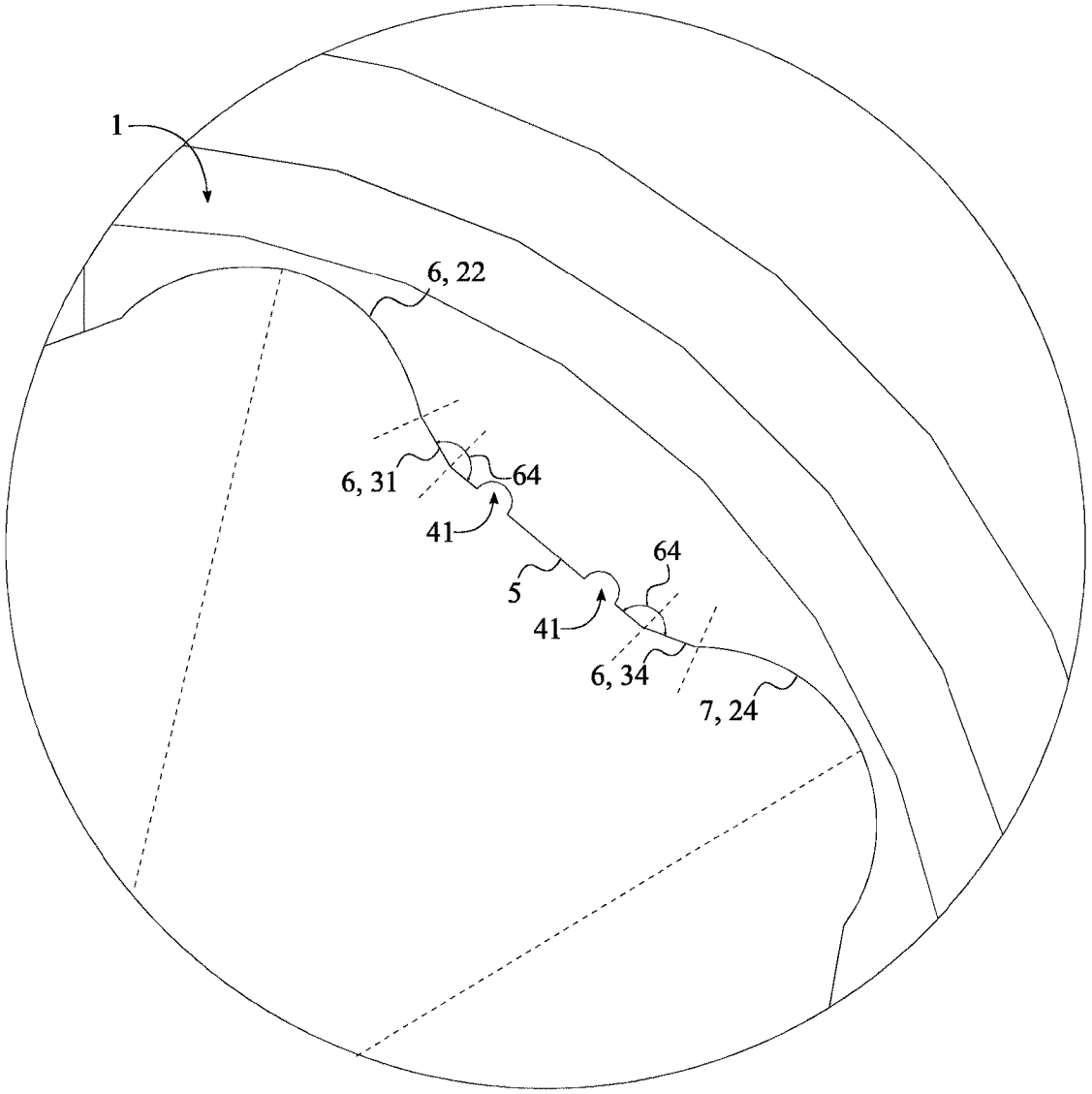
FIG. 19 is a detailed view for the fifth configuration of the first opposing feature.
Figure 20:
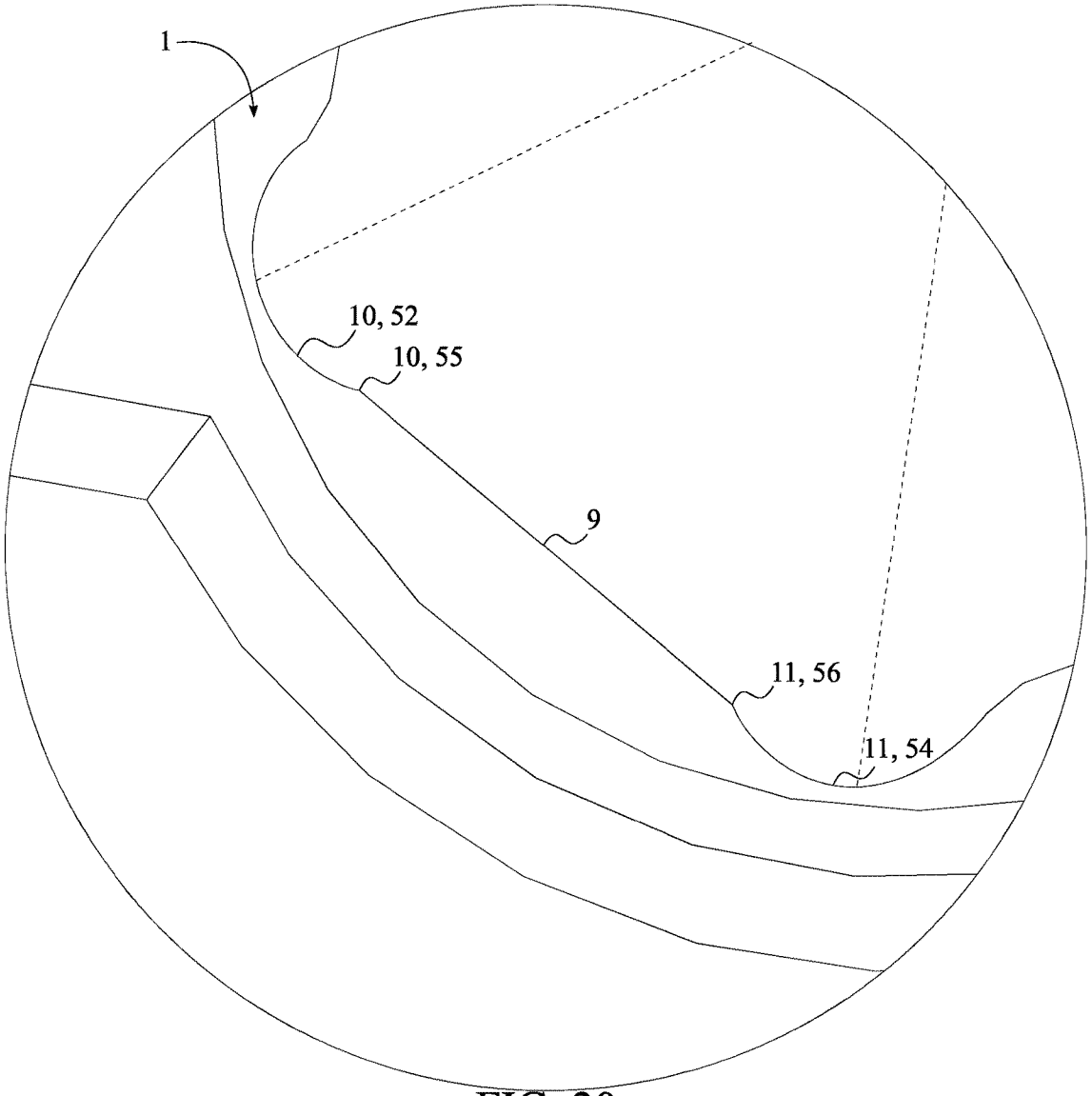
FIG. 20 is a detailed view for the second configuration of the second opposing feature.

In reference to the second configuration of the second opposing feature 8, the second distal cavity surface 10 comprises a second distal edge 55 and a second distal arc section 52 as shown in FIG. 16 and FIG. 20. The second proximal cavity surface 11 comprises a second proximal edge 56 and a second proximal arc section 54. More specifically, the second distal arc section 52 and the second proximal arc section 54 are oppositely positioned of each other about the second flat-bracing surface 9 so that the general shape of the second opposing feature 8 can be delineated. The second distal arc section 52 is terminally connected to the second flat-bracing surface 9 about the second distal edge 55, wherein the second distal edge 55 forms a sharp edge as the second distal arc section 52 traverses into the torque-tool body 1. The second proximal arc section 54 is terminally connected to the second flat-bracing surface 9 about the second proximal edge 56, wherein the second proximal edge 56 forms a sharp edge as the second proximal arc section 54 traverses into the torque-tool body 1.

It is further understood that even though the aforementioned describes the first opposing feature 4 being of a different configuration to the second opposing feature 8, the pair of diametrically opposing engagement features 3 may be the same features. In other words, the first opposing feature 4 and the second opposing feature 8 may be two of the same features opposing each other if preferred by the consumer.

Regarding the set of serrations 41, each cavity of the set of serrations 41 and the first flat-bracing surface 5 intersect at a point; however, a small radius section may be used at the intersecting point to remove the sharp edge if preferred by the user. Depth of each cavity for the set of serrations 41 is less than the depth of the first distal concave sections 32 and the proximal concave section 34 and are not collinear. Each cavity of the set of serrations 41 is preferably a partially circular shape. However, the shape for each cavity of the set of serrations 41 may be any shape including but not limited to oval, square, triangular, trapezoidal or a combination of the aforesaid shapes.

Each cavity for the set of serrations 41 cut into the first flat-bracing surface 5 and the second flat-bracing surface 9 at equal depths, although each cavity may not be collinear with each other if preferred by the user.

The first distal angled sections 31 and the first proximal angled sections 34 together with first flat-bracing surface 5 may yield a trapezoidal shape, thought the scope is not limited to this shape.

An intermediate length 104 that is delineated within the set of serrations 41 is equal to a range of approximately 0.33 to 0.5 of a total length of the first flat bracing surface 5.

When the present invention is placed on a fastener head, the first distal convex section 21, the first proximal convex section 24, the first distal angled section 31, the first proximal angled section 34, the first distal concave section 32, and the first proximal concave section 35 may not contact the fastener head until torque force is applied.

The first flat-bracing surface 5 and the second flat-bracing surface 9 engage with the fastener head at an angle range of approximately 1 to 10 degrees. When the first flat-bracing surface 5 and the second flat-bracing surface 9 are engaged with the fastener head, at the preferred engagement angle, the engagement with the fastener is at an approximate range of ¼ to ⅓ of the length of the fastener flank surface from one of the lateral corner of the fastener head.

Although the invention has been explained in relation to its preferred embodiment, it is to be understood that many other possible modifications and variations can be made without departing from the spirit and scope of the invention as hereinafter claimed.

What is claimed is:

1. An anti-slip torque tool with integrated engagement features comprising:

a torque-tool body;

at least one pair of diametrically opposing engagement features;

at least one intermediate feature;

the pair of diametrically opposing engagement features comprising a first opposing feature and a second opposing feature;

the first opposing feature comprising a first flat-bracing surface, a first distal cavity surface, and a first proximal cavity surface;

the second opposing feature comprising a second flat-bracing surface, a second distal cavity surface, and a second proximal cavity surface;

the first opposing feature and the second opposing feature being radially distributed around a rotational axis of the torque-tool body;

the first opposing feature and the second opposing feature being terminally connected to each other by the intermediate feature;

the torque-tool body being outwardly extended from the first opposing feature, the second opposing feature, and the intermediate feature;

the first distal cavity surface and the first proximal cavity surface being oppositely positioned of each other about the first flat-bracing surface;

the first distal cavity surface being terminally connected to the first flat-bracing surface;

the first proximal cavity surface being terminally connected to the first flat-bracing surface;

the second distal cavity surface and the second proximal cavity surface being oppositely positioned of each other about the second flat-bracing surface;

the second distal cavity surface being terminally connected to the second flat-bracing surface;

the second proximal cavity surface being terminally connected to the second flat-bracing surface;

the first proximal cavity surface and the second proximal cavity surface being terminally connected to the intermediate feature;

the second distal cavity surface comprising a distal convex section and a distal arc section;

the second proximal cavity surface comprising a proximal convex section and a proximal arc section;

the distal convex section and the distal arc section being adjacently connected to each other;

the proximal convex section and the proximal arc section being adjacently connected to each other;

the distal convex section and the proximal convex section being oppositely positioned of each other about the second flat-bracing surface;

the distal convex section being terminally connected to the second flat-bracing surface; and the proximal convex section being terminally connected to the second flat-bracing surface.

2. The anti-slip torque tool with integrated engagement features as claimed in claim 1 comprises:

a wrench handle; and the wrench handle being externally and laterally connected to the torque-tool body.

3. The anti-slip torque tool with integrated engagement features as claimed in claim 1 comprises, wherein the first flat-bracing surface and the second flat-bracing surface are positioned parallel to each other.

4. The anti-slip torque tool with integrated engagement features as claimed in claim 1 comprises:

the first distal cavity surface comprising another distal convex section and another distal arc section;

the first proximal cavity surface comprising another proximal convex section and another proximal arc section;

the another distal convex section and the another distal arc section being adjacently connected to each other;

the another proximal convex section and the another proximal arc section being adjacently connected to each other;

the another distal convex section and the another proximal convex section being oppositely positioned of each other about the first flat-bracing surface;

the another distal convex section being terminally connected to the first flat-bracing surface; and the another proximal convex section being terminally connected to the first flat-bracing surface.

5. The anti-slip torque tool with integrated engagement features as claimed in claim 4 comprises:

a set of serrations; and the set of serrations being laterally traversing into the torque-tool body from the first flat-bracing surface.

6. The anti-slip torque tool with integrated engagement features as claimed in claim 4 comprises:

wherein an arc length of the first distal convex section ranges from 15%-25% of a total length of the first opposing feature;

wherein an arc length of the first proximal convex section ranges from 15%-25% of the total length of the first opposing feature; and wherein a length of the first flat-bracing surface ranges from 30%-60% of the total length of the first opposing feature.

7. The anti-slip torque tool with integrated engagement features as claimed in claim 1 comprises:

the first distal cavity surface comprising a first distal angled section, a first distal concave section, and a first distal arc section;

the first proximal cavity surface comprising a first proximal angled section, a first proximal concave section, and a first proximal arc section;

the first distal angled section and the first distal arc section being oppositely positioned of each other about the first distal concave section;

the first distal angled section and the first distal arc section being terminally connected to the first distal concave section;

the first proximal angled section and the first proximal arc section being oppositely positioned of each other about the first proximal concave section;

the first proximal angled section and the first proximal arc section being terminally connected to the first proximal concave section;

the first distal angled section and the first proximal angled section being oppositely positioned of each other about the first flat-bracing surface;

the first distal angled section being terminally connected to the first flat-bracing surface at a first obtuse angle; and the first proximal angled section being terminally connected to the first flat-bracing surface at the first obtuse angle.

8. The anti-slip torque tool with integrated engagement features as claimed in claim 7 comprises:

wherein a length of the first flat-bracing surface ranges from 30%-60% of a total length of the first opposing feature;

wherein a length of the first distal angled section ranges from 15%-25% of the length of the first flat-bracing surface; and wherein a length of the first proximal angled section ranges from 15%-25% of the length of the first flat-bracing surface.

9. The anti-slip torque tool with integrated engagement features as claimed in claim 7, wherein the first obtuse angle ranges from 91 degrees to 165 degrees.

10. The anti-slip torque tool with integrated engagement features as claimed in claim 1 comprises:

a set of serrations;

the first distal cavity surface comprising a first distal angled section, a first distal concave section, and a first distal arc section;

the first proximal cavity surface comprising a first proximal angled section, a first proximal concave section, and a first proximal arc section;

the first distal angled section and the first distal arc section being oppositely positioned of each other about the first distal concave section;

the first distal angled section and the first distal arc section being terminally connected to the first distal concave section;

the first proximal angled section and the first proximal arc section being oppositely positioned of each other about the first proximal concave section;

the first proximal angled section and the first proximal arc section being terminally connected to the first proximal concave section;

the first distal angled section and the first proximal angled section being oppositely positioned of each other about the first flat-bracing surface;

the first distal angled section being terminally connected to the first flat-bracing surface at a second obtuse angle;

the first proximal angled section being terminally connected to the first flat-bracing surface at the second obtuse angle; and the set of serrations being laterally traversing into the torque-tool body from the first flat-bracing surface.

11. The anti-slip torque tool with integrated engagement features as claimed in claim 10 comprises:

wherein a length of the first flat-bracing surface ranges from 30%-60% of a total length of the first opposing feature;

wherein a length of the first distal angled section ranges from 15%-25% of the length of the first flat-bracing surface; and wherein a length of the first proximal angled section ranges from 15%-25% of the length of the first flat-bracing surface.

12. The anti-slip torque tool with integrated engagement features as claimed in claim 10, wherein the second obtuse angle ranges from 91 degrees to 165 degrees.

13. The anti-slip torque tool with integrated engagement features as claimed in claim 1 comprises:

the first distal cavity surface comprising a first distal angled section and a first distal arc section;

the first proximal cavity surface comprising a first proximal angled section and a first proximal arc section;

the first distal angled section and the first distal arc section being adjacently connected to each other;

the first proximal angled section and the first proximal arc section being adjacently connected to each other;

the first distal angled section and the first proximal angled section being oppositely positioned of each other about the first flat-bracing surface;

the first distal angled section being terminally connected to the first flat-bracing surface at a third obtuse angle; and the first proximal angled section being terminally connected to the first flat-bracing surface at the third obtuse angle.

14. The anti-slip torque tool with integrated engagement features as claimed in claim 13, wherein the third obtuse angle ranges from 91 degrees to 165 degrees.

15. The anti-slip torque tool with integrated engagement features as claimed in claim 1 comprises:

a set of serrations;

the first distal cavity surface comprising a first distal angled section, and a first distal arc section;

the first proximal cavity surface comprising a first proximal angled section and a first proximal arc section;

the first distal angled section and the first distal arc section being adjacently connected to each other;

the first proximal angled section and the first proximal arc section being adjacently connected to each other;

the first distal angled section and the first proximal angled section being oppositely positioned of each other about the first flat-bracing surface;

the first distal angled section being terminally connected to the first flat-bracing surface at a fourth obtuse angle;

the first proximal angled section being terminally connected to the first flat-bracing surface at the fourth obtuse angle; and the set of serrations laterally traversing into the torque-tool body from the first flat-bracing surface.

16. The anti-slip torque tool with integrated engagement features as claimed in claim 15, wherein the fourth obtuse angle ranges from 91 degrees to 165 degrees.

* * * * *